US006665972B2

(12) United States Patent
Hensel

(10) Patent No.: US 6,665,972 B2
(45) Date of Patent: Dec. 23, 2003

(54) REFRIGERATOR ARTWORK ORGANIZER

(76) Inventor: Vicki L. Hensel, 224 Rolshouse Rd., PGH, PA (US) 15237

( * ) Notice: Subject to any disclaimer, the term of this patent is extended or adjusted under 35 U.S.C. 154(b) by 217 days.

(21) Appl. No.: 09/930,729

(22) Filed: Aug. 15, 2001

(65) Prior Publication Data

US 2003/0033741 A1 Feb. 20, 2003

(51) Int. Cl.[7] ..... A47G 1/06
(52) U.S. Cl. ..... 40/711; 40/721; 40/729
(58) Field of Search ..... 40/600, 711, 721, 40/729, 606.19, 765; D6/300, 301, 302

(56) References Cited

U.S. PATENT DOCUMENTS

| | | | | | |
|---|---|---|---|---|---|
| 1,068,621 | A | * | 7/1913 | Abraham | 40/721 |
| 3,251,151 | A | * | 5/1966 | Sherrill | 40/721 X |
| 3,606,507 | A | | 9/1971 | Williams | |
| 4,231,174 | A | | 11/1980 | Thompson | |
| 4,663,874 | A | * | 5/1987 | Sano et al. | 40/600 X |
| 4,730,736 | A | | 3/1988 | Lindquist et al. | |
| 4,785,562 | A | | 11/1988 | Good | |
| 4,852,282 | A | * | 8/1989 | Selman | 40/600 X |
| 5,237,763 | A | * | 8/1993 | Ochoa | 40/721 |
| 5,274,937 | A | * | 1/1994 | Birnbaum | 40/600 |
| 5,400,532 | A | * | 3/1995 | Grove | 40/721 |
| D377,506 | S | | 1/1997 | Shaw | |
| 5,755,337 | A | | 5/1998 | Linn | |
| 6,347,467 | B1 | * | 2/2002 | Meyer | 40/729 X |

* cited by examiner

*Primary Examiner*—Joanne Silbermann

(57) ABSTRACT

The Refrigerator Artwork Organizer disclosed is an apparatus for storing and displaying pictures on a flat metal surface. In the preferred embodiment, the Refrigerator Artwork Organizer consists of a first holder with a first viewer that will display a 8.5"×11" piece of paper. Behind the first viewer is a storage container for similar pictures which are not currently being viewed. Atop the storage container is a second holder. The second holder accommodates one 4"×6" photograph and displays it through a second viewer at the same time as the picture is displayed in the first holder. A magnetic backing is adhered to the back of the Refrigerator Artwork Organizer and is strong enough to magnetically secure the Refrigerator Artwork Organizer and its contents to a flat metal surface, such as a refrigerator, filing cabinet, or door.

14 Claims, 4 Drawing Sheets

REFRIGERATOR ARTWORK ORGANIZER

FIELD OF INVENTION

The present invention is directed to magnetic organizers and display units.

BACKGROUND

The refrigerator has become a family display area for photographs, schoolwork, and children's artwork. The most common method for securing these items to the refrigerator is with small magnets. However, the magnets are often not sufficient to hold more than one sheet of paper.

U.S. Pat. No. 4,785,562 (the '562 patent) discloses a "Magnetic Display Holder" having a frame containing magnets which attach to a metal surface. The '562 patent discloses an apparatus for framing pictures and securing them to a metal surface. However, a need exists beyond the '562 patent for an apparatus that can be secured to a metal surface and that can also accommodate a plurality of pictures and provide storage for other pictures or items.

SUMMARY OF INVENTION

The Refrigerator Artwork Organizer disclosed is an apparatus for storing and displaying pictures by attaching the apparatus to a flat metal surface. In the preferred embodiment, the Refrigerator Artwork Organizer consists of a first holder with a first viewer to display up to a 8.5"×11" piece of paper. Behind the first viewer is a storage container for papers or pictures which not being viewed. Atop the storage container is a second holder. The second holder accommodates up to a 4"×6" photograph or piece of paper and displays it through the second viewer at the same time as the picture is displayed in the first holder. A magnetic backing is adhered to the back of the Refrigerator Artwork Organizer to magnetically secure the Refrigerator Artwork Organizer and its contents to a flat metal surface, such as a refrigerator, filing cabinet, or door.

In the preferred embodiment, the Refrigerator Artwork Organizer is unitary in construction and made of clear plastic or a similar material. In an alternative embodiment, the Refrigerator Artwork Organizer is made of wood and glass or clear plastic and its components are adhered together. However, different materials and configurations are available and may be determined by those skilled in the art. In other alternative embodiments, the dimensions of the picture and second holder may be altered to accommodate different sized pictures and photographs. The size of the first holder and second holder depend on the application and should be determined by those skilled in the art.

DESCRIPTION OF PREFERRED EMBODIMENTS

Figure 1:
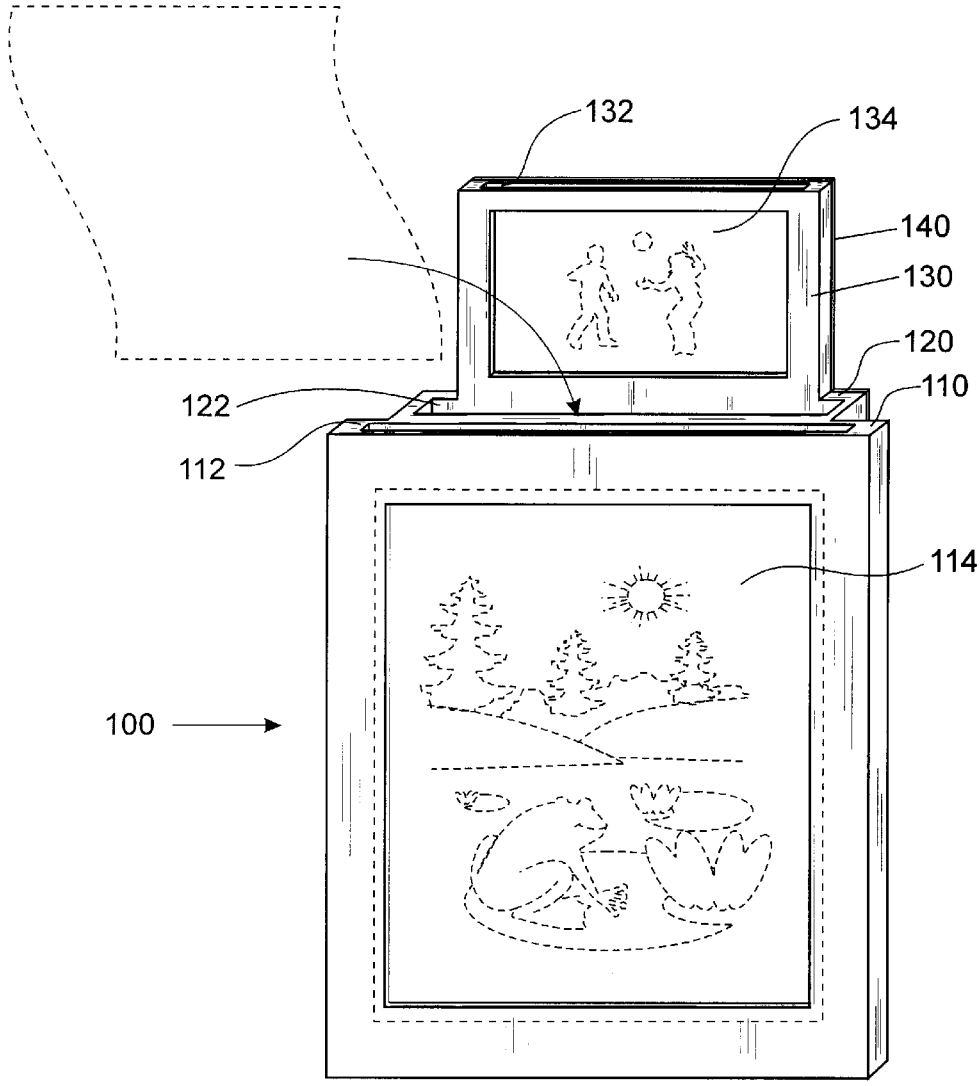
FIG. 1 is a frontal prospective view of the Refrigerator Artwork Organizer showing the first holder, storage, and the second holder.
Figure 2:
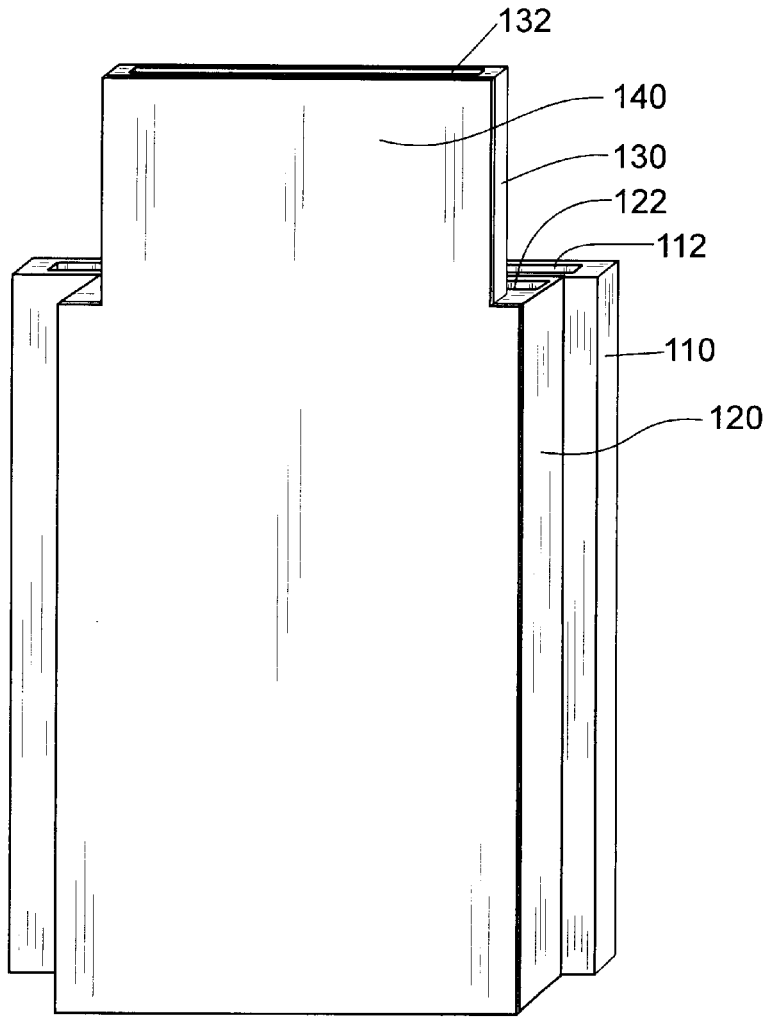
FIG. 2 is a rear prospective view of the Refrigerator Artwork Organizer showing the magnetic backing.
Figure 3:
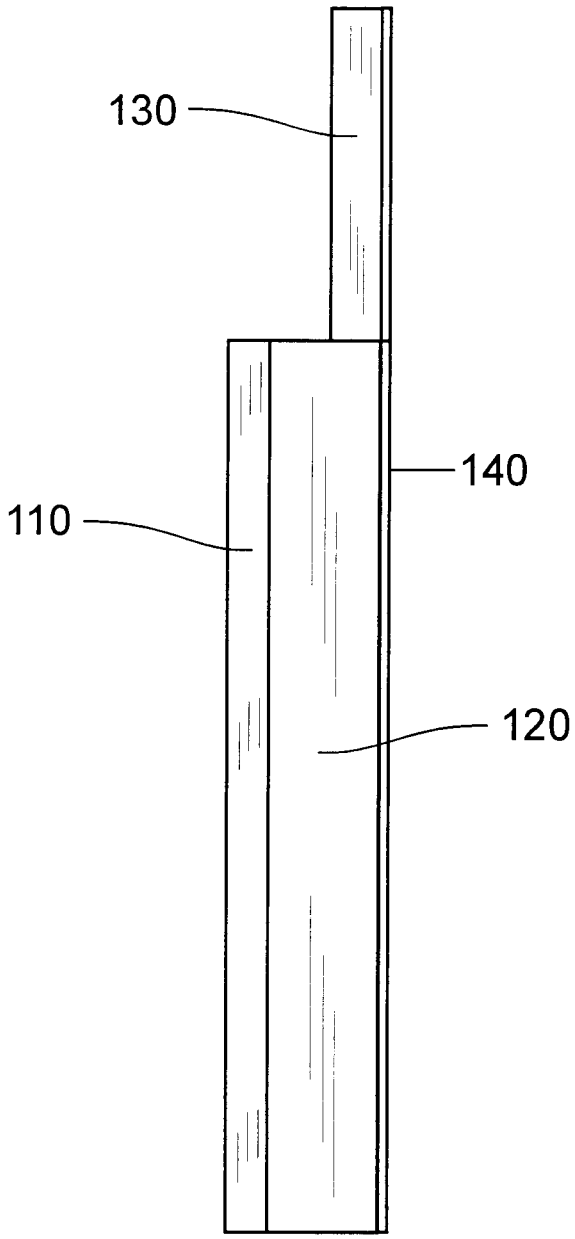
FIG. 3 is a side elevation view of the Refrigerator Artwork Organizer showing the first holder, the storage, the second holder, and the magnetic backing.
Figure 4:
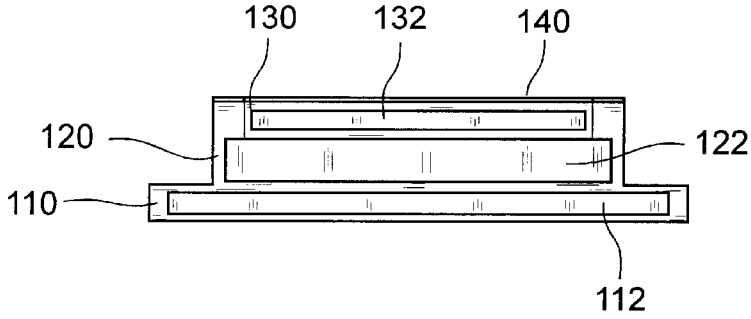
FIG. 4 is a top plan view of the Refrigerator Artwork Organizer showing the first holder slot, the second holder slot, and the storage slot.
Figure 5:
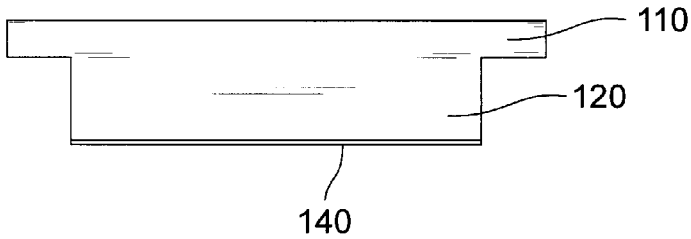
FIG. 5 is a bottom plan view of the Refrigerator Artwork Organizer showing the first holder, storage, and magnetic backing.

As seen in FIG. 1, organizer 100 comprises first holder 110, storage 120, and second holder 130. First holder 110 is rectangular in shape and contains first holder slot 112 and first viewer 114. First holder slot 112 is a rectangular slot in first holder 110 that will allow a 8.5"×11" piece of paper to be fully inserted into first holder 110. First viewer 114 is a rectangular area in the frontal face of first holder 110 that is clear plastic and large enough to allow viewing of a picture or piece of paper inserted into first holder slot 112.

Storage 120 is fixedly joined to the back of first holder 110 by unitary construction. Storage 120 is rectangular in shape and contains storage slot 122, which is a rectangular slot that can accommodate at least one 8.5"×11" piece of paper.

Second holder 130 is fixedly joined to the top of storage 120 by unitary construction. Second holder 130 is rectangular in shape and contains second holder slot 132 and second viewer 134. Second holder slot 132 is a rectangular slot in second holder 130 that will allow a 4"×6" piece of paper or photograph to be fully inserted into second holder 130. Second viewer 134 is a rectangular area in the frontal face of second holder 130 that is clear plastic and large enough to allow viewing of a picture or piece of paper inserted into second holder slot 132.

Magnetic backing 140 is made of a magnetic material that will secure organizer 100 to a flat metal surface, such as a refrigerator, filing cabinet, or door. Magnetic backing 140 is adhered to the back of storage 120 and second holder 130 by an appropriate adhesive as determined by those skilled in the art. The magnetic properties of magnetic backing 140 are sufficient to support the weight of organizer 100 and the contents contained therein.

What is claimed:

1. An apparatus for organizing and displaying a plurality of papers or photographs comprising:

a first holder having a first holder slot and a first viewer;

a storage section, wherein the storage is fixedly joined to a back of the first holder;

a second holder having a second holder slot and a second viewer, wherein the second holder is fixedly joined to a top of the storage section so that the second viewer is positioned completely above the first viewer; and wherein the apparatus is adapted for removable engagement to a flat metal surface.

2. The apparatus in claim 1 further comprising a magnetic backing, wherein the magnetic backing covers the entire back surface of the storage section and the second holder.

3. The apparatus of claim 1 wherein the first holder slot is in the top of the first holder and allows insertion and removal of a first paper or a first photograph into the fast holder.

4. The apparatus of claim 1 wherein the first holder viewer is part of the frontal face of the first holder and allows a first paper or a first photograph inside the first holder to be viewed.

5. The apparatus of claim 1 wherein the second holder slot is in the top of the second holder and allows insertion and removal of a second paper or a second photograph into the second holder.

6. The apparatus of claim 1 wherein the second holder viewer is part of a frontal face of the second holder and allows a second paper or a second photograph inside the second holder to be viewed.

7. An apparatus for organizing and displaying a plurality of papers or photographs comprising:

a first holder;

a storage section, wherein the storage is fixedly joined to a back of the first holder;

a second holder, wherein the second holder is fixedly joined to a top of the storage section so that the second holder is positioned completely above the first holder; and a magnetic backing, wherein the magnetic backing covers the entire back surface of the storage section and the second holder and is adapted for removable engagement of the apparatus to a flat metal surface.

8. The apparatus in claim 7 further comprising a first holder slot, wherein the first holder slot is in the top of the first holder and allows insertion and removal of a first paper or a first photograph into the first holder.

9. The apparatus in claim 7 further comprising a first holder viewer, wherein the first holder viewer is part of the a frontal face of the first viewer and allows a first paper or a first photograph inside the first holder to be viewed.

10. The apparatus in claim 7 further comprising a second holder slot, wherein the second holder slot is in the top of the second holder and allows insertion and removal of second paper or a second photograph into the second holder.

11. The apparatus in claim 7 further comprising a second holder viewer, wherein the second holder viewer is part of a frontal face of the second holder and allows a second paper or a second photograph inside the second holder to be viewed.

12. An apparatus for organizing and displaying a plurality of papers or photographs comprising:

a first holder a first holder slot, wherein the first holder slot is in the top of the first holder and allows insertion and removal of a first paper or a first photograph into the first holder;

a storage section, wherein the storage is fixedly joined to a back of the first holder;

a second holder, wherein the second holder is fixedly joined to a top of the storage section so that the second holder is positioned completely above the first holder;

a second holder slot, wherein the second holder slot is in the top of the second holder and allows insertion and removal of a second paper or a second photograph into the second holder; and a magnetic backing, wherein the magnetic backing covers the entire back surface of the storage section and second holder and is adapted for removable engagement to a flat metal surface.

13. The apparatus in claim 12 further comprising a first holder viewer, wherein the first holder viewer is part of a frontal face of the first viewer and allows a first paper or a first photograph inside the first holder to be viewed.

14. The apparatus in claim 12 further comprising a second holder viewer, wherein the second holder viewer is part of a frontal face of the second holder and allows a second paper or a second photograph inside the second holder to be viewed.

* * * * *